US006988782B2

(12) United States Patent
Imanaka et al.

(10) Patent No.: US 6,988,782 B2
(45) Date of Patent: Jan. 24, 2006

(54) RECORDING APPARATUS AND LIQUID DISCHARGE METHOD

(75) Inventors: Yoshiyuki Imanaka, Kanagawa (JP); Ichiro Saito, Kanagawa (JP); Yoshinori Misumi, Tokyo (JP); Hidehiko Kanda, Kanagawa (JP); Muga Mochizuki, Kanagawa (JP); Takaaki Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 10/293,359

(22) Filed: Nov. 14, 2002

(65) Prior Publication Data

US 2003/0090533 A1 May 15, 2003

(30) Foreign Application Priority Data

Nov. 15, 2001 (JP) ..... 2001-350263

(51) Int. Cl.
*B41J 29/38* (2006.01)

(52) U.S. Cl. ..... 347/11; 347/14

(58) Field of Classification Search ..... 347/9–11, 347/14

See application file for complete search history.

(56) References Cited

U.S. PATENT DOCUMENTS

| | | | | |
|---|---|---|---|---|
| 4,723,129 | A | 2/1988 | Endo et al. | 347/63 |
| 6,116,714 | A | 9/2000 | Imanaka et al. | 347/19 |
| 6,224,195 | B1 | 5/2001 | Maru et al. | 347/60 |
| 6,293,655 | B1 | 9/2001 | Imanaka et al. | 347/65 |
| 6,331,039 | B1 | 12/2001 | Iwasaki et al. | |
| 6,409,300 | B2 | 6/2002 | Imanaka et al. | |
| 6,431,685 | B1 | 8/2002 | Misumi | 347/57 |
| 6,439,680 | B1 | 8/2002 | Mochizuki et al. | 347/10 |
| 6,447,085 | B1 | 9/2002 | Yagi et al. | |
| 6,454,379 | B1 | 9/2002 | Taneya et al. | 347/19 |
| 6,464,320 | B1 | 10/2002 | Maru et al. | 347/19 |
| 6,467,863 | B1 | 10/2002 | Imanaka et al. | 347/9 |
| 6,652,055 | B2 | 11/2003 | Oikawa | 347/9 |

FOREIGN PATENT DOCUMENTS

| | | |
|---|---|---|
| JP | 7-52387 | 2/1995 |
| JP | 8-39808 | 2/1996 |

OTHER PUBLICATIONS

*Note: U.S. counterpart Patent No. 6,331,039 also enclosed.
10/282,178.*
10/290,531.*

* cited by examiner

*Primary Examiner*—Michael S Brooke
(74) *Attorney, Agent, or Firm*—Fitzpatrick, Cella, Harper & Scinto

(57) ABSTRACT

The invention intends to maintain a constant ink discharge amount among the recording heads, even in case a total pulse width of pulse voltages applied to heat generating resistors. For this purpose, a rank table is prepared in such a manner, even in a situation where a total pulse width of the pulses applied to the heat generating resistor is 3 μs or less whereby the ink discharge amount decreases with a decrease in the total pulse width, that a maximum reached temperature on the surface of the heat generating resistors at the application of a preheat pulse becomes higher with a decrease in the resistance of a rank resistor, and a pulse width $P_1$ on the rank table is made longer thereby compensating a decrease in the ink discharge amount with a decrease in the total pulse width and maintaining a constant ink discharge amount.

11 Claims, 11 Drawing Sheets

| RANK | RANK RESISTOR [Ω] | DOUBLE PULSE | | |
|---|---|---|---|---|
| | | PRE PULSE P1 [μs] | OFF TIME P2 [μs] | MAIN PULSE P3 [μs] |
| 1 | 435 — 444 | 0.375 | 2.375 | 0.833 |
| 2 | 445 — 454 | 0.375 | 2.375 | 0.875 |
| 3 | 455 — 464 | 0.375 | 2.375 | 0.917 |
| 4 | 465 — 474 | 0.417 | 2.375 | 0.875 |
| 5 | 475 — 484 | 0.417 | 2.375 | 0.917 |
| 6 | 485 — 494 | 0.417 | 2.375 | 0.958 |
| 7 | 495 — 504 | 0.458 | 2.375 | 0.958 |
| 8 | 505 — 514 | 0.458 | 2.375 | 1.000 |
| 9 | 515 — 524 | 0.458 | 2.375 | 1.042 |
| 10 | 525 — 534 | 0.500 | 2.375 | 1.000 |
| 11 | 535 — 544 | 0.500 | 2.375 | 1.042 |
| 12 | 545 — 554 | 0.500 | 2.375 | 1.093 |
| 13 | 555 — 564 | 0.500 | 2.375 | 1.125 |
| 14 | 565 — 574 | 0.500 | 2.375 | 1.167 |
| 15 | 575 — 584 | 0.500 | 2.375 | 1.208 |
| 16 | 585 — 594 | 0.500 | 2.375 | 1.250 |
| 17 | 595 — 604 | 0.500 | 2.375 | 1.292 |
| 18 | 605 — 614 | 0.542 | 2.375 | 1.250 |
| 19 | 615 — 624 | 0.542 | 2.375 | 1.292 |
| 20 | 625 — 634 | 0.542 | 2.375 | 1.333 |
| 21 | 635 — 644 | 0.542 | 2.375 | 1.375 |
| 22 | 645 — 654 | 0.542 | 2.375 | 1.417 |

FIG. 3

| RANK | RANK RESISTOR [Ω] | DOUBLE PULSE | | |
|---|---|---|---|---|
| | | PRE PULSE P1 [μs] | OFF TIME P2 [μs] | MAIN PULSE P3 [μs] |
| 1 | 435 — 444 | 0.375 | 2.375 | 0.833 |
| 2 | 445 — 454 | 0.375 | 2.375 | 0.875 |
| 3 | 455 — 464 | 0.375 | 2.375 | 0.917 |
| 4 | 465 — 474 | 0.417 | 2.375 | 0.875 |
| 5 | 475 — 484 | 0.417 | 2.375 | 0.917 |
| 6 | 485 — 494 | 0.417 | 2.375 | 0.958 |
| 7 | 495 — 504 | 0.458 | 2.375 | 0.958 |
| 8 | 505 — 514 | 0.458 | 2.375 | 1.000 |
| 9 | 515 — 524 | 0.458 | 2.375 | 1.042 |
| 10 | 525 — 534 | 0.500 | 2.375 | 1.000 |
| 11 | 535 — 544 | 0.500 | 2.375 | 1.042 |
| 12 | 545 — 554 | 0.500 | 2.375 | 1.093 |
| 13 | 555 — 564 | 0.500 | 2.375 | 1.125 |
| 14 | 565 — 574 | 0.500 | 2.375 | 1.167 |
| 15 | 575 — 584 | 0.500 | 2.375 | 1.208 |
| 16 | 585 — 594 | 0.500 | 2.375 | 1.250 |
| 17 | 595 — 604 | 0.500 | 2.375 | 1.292 |
| 18 | 605 — 614 | 0.542 | 2.375 | 1.250 |
| 19 | 615 — 624 | 0.542 | 2.375 | 1.292 |
| 20 | 625 — 634 | 0.542 | 2.375 | 1.333 |
| 21 | 635 — 644 | 0.542 | 2.375 | 1.375 |
| 22 | 645 — 654 | 0.542 | 2.375 | 1.417 |

FIG. 10
(CONVENTIONAL ART)

| RANK | RANK RESISTOR [Ω] | DESIGNATED DRIVE CONDITION (23℃) P1-P2-P3 [μs] |
|---|---|---|
| 1 | 884 — 911 | 1.12 – 1.72 – 2.44 |
| 2 | 912 — 925 | 1.16 – 1.72 – 2.44 |
| 3 | 926 — 938 | 1.16 – 1.72 – 2.52 |
| 4 | 939 — 951 | 1.20 – 1.72 – 2.56 |
| 5 | 952 — 964 | 1.20 – 1.72 – 2.64 |
| 6 | 965 — 977 | 1.24 – 1.72 – 2.64 |
| 7 | 978 — 991 | 1.24 – 1.72 – 2.72 |
| 8 | 992 — 1004 | 1.24 – 1.72 – 2.80 |
| 9 | 1005 — 1017 | 1.28 – 1.72 – 2.84 |
| 10 | 1018 — 1030 | 1.28 – 1.72 – 2.92 |
| 11 | 1031 — 1043 | 1.32 – 1.72 – 2.96 |
| 12 | 1044 — 1057 | 1.32 – 1.72 – 3.04 |
| 13 | 1058 — 1070 | 1.36 – 1.72 – 3.08 |
| 14 | 1071 — 1083 | 1.36 – 1.72 – 3.16 |
| 15 | 1084 — 1096 | 1.40 – 1.72 – 3.20 |
| 16 | 1097 — 1109 | 1.40 – 1.72 – 3.28 |
| 17 | 1110 — 1123 | 1.40 – 1.72 – 3.36 |
| 18 | 1124 — 1136 | 1.44 – 1.72 – 3.40 |
| 19 | 1137 — 1149 | 1.44 – 1.72 – 3.48 |
| 20 | 1150 — 1162 | 1.48 – 1.72 – 3.56 |
| 21 | 1163 — 1175 | 1.48 – 1.72 – 3.64 |
| 22 | 1176 — 1189 | 1.52 – 1.72 – 3.68 |
| 23 | 1190 — 1202 | 1.52 – 1.72 – 3.76 |
| 24 | 1203 — 1228 | 1.56 – 1.72 – 3.84 |

RECORDING APPARATUS AND LIQUID DISCHARGE METHOD

BACKGROUND OF THE INVENTION

1. Field of the Invention

The present invention relates to a recording apparatus provided with a recording head in which an energy conversion element is formed for converting an electrical energy into a printing energy for printing on a recording medium, and more particularly a recording apparatus provided with a recording head including a semiconductor substrate in which formed is a print energy generating element for generating a print energy. The printing on the recording medium includes not only an operation of printing a character but also an operation of a symbol, a pattern etc. other than the character.

2. Related Background Art

There is already known so-called bubble jet recording method, or an ink jet recording method which gives an energy such as heat to an ink thereby causing a state change involving a rapid volume change (generation of a bubble) in a liquid such as ink, discharging the ink from a discharge port by a force based on such state change and depositing the ink on a recording medium thereby achieving an image formation. A recording apparatus utilizing such bubble ink jet recording method is generally provided, as disclosed in U.S. Pat. No. 4,723,129, with a discharge port for discharging the ink, an ink flow path communicating with the discharge port, and a heat-generating resistor provided in the ink flow path and constituting energy generation means for ink discharge.

Such recording method has various advantages such as being capable of recording an image of a high quality with a low noise level, and, since the discharge ports for discharging ink can be arranged in a high density in a recording head for executing such recording method, also capable of obtaining a recorded image of a high resolution or even a color image with a compact apparatus. Therefore the bubble jet recording method is recently utilized in various office equipment such as a printer, a copying machine and a facsimile, and is being further utilized in industrial systems such as a textile dyeing apparatus.

The heat generating resistor for generating energy for ink discharge can be prepared by a semiconductor manufacturing process. Therefore, a conventional recording head utilizing the bubble jet technology has a configuration obtained by forming a heat generating resistor on an element substrate constituted by a silicon substrate, and adhering thereon a top plate which is composed of a resin such as polysulfone or glass and in which a groove is formed for forming the ink flow path.

Utilizing a fact that the element substrate is composed of a silicon substrate, there is also known a configuration in which not only the heat generating resistor is formed on the element substrate but also a driver for driving the heat generating resistor, a temperature sensor to be used in controlling the heat generating resistor according to the temperature of the head and a drive control unit therefore are formed on the element substrate (for example Japanese Patent Application Laid-Open No. 7-52387). A head including the driver, the temperature sensor, the drive control unit therefore etc. on the element substrate is already in commercial use, and is contributing to an improvement in the reliability of the recording head and a compactization of the apparatus.

FIG. 6 is a block diagram showing an example of the driver formed on the element substrate. A recording head includes 128 nozzles (discharge ports) and heat generating resistors corresponding thereto. The heat generating resistors are represented by seg1 to seg128. A terminal Vh is a common terminal which is common to 128 heat generating resistors. Vh is given a voltage of 20 to 35 V at the recording operation. A terminal Top(Rnk) is used for judging a rank of the recording head in a tank table to be explained later, and corrects a width or a height of a driving pulse for the heat generating resistor or a drive timing according to the value of an internal rank resistor 141, thereby achieving such control as to discharge an ink droplet of a same volume from any recording head. A terminal $GND_H$ provides a reference potential for a heat generating resistor drive circuit 128. A terminal SUB is used for a sub heater 142. The sub heater 142 is used in case of elevating the temperature of the recording head. The sub heater 142 is provided in two units, at the left and right sides of the recording head.

HeatEN-A and HeatEN-B indicate enable signal terminals for driving the heat generating resistors. The HeatEN-A and HeatEN-B are made independently controllable. Terminals RESET, CLK-A, CLK-B and U/D are related to counters 144A, 144B for selecting a nozzle for data setting, in each block. Next to the counters 144 there is provided a decoder 145, and, next thereto there is provided a logic circuit which forms a logic product with a recording signal and which is connected to the heat generating resistors through a transistor array 147. RESET indicates a clear terminal for the counters 144. CLK-A and CLK-B indicate clock terminals for input to the counters 144A and 144B. U/D indicates a terminal for selecting an up/down state of the counters 144. In a reciprocating recording operation, the recording is executed by alternating the up state and the down state, for example an up state in the forward motion and a down state in the reverse motion. IDATA indicates a data input terminal, in which data are entered in synchronization with a data clock signal from a DCLK terminal, then guided through a serial-parallel conversion circuit 148 of 128 bits, and temporarily latched in a latch circuit of 128 bits. The RESET terminals also serves for resetting the latch circuit 149, and an LTCLK terminal is used for providing the latch circuit 149 with a latch signal.

A terminal $V_{DD}$ is a power supply voltage input terminal for a logic system, and applies a voltage of 5 V. A terminal $GND_L$ provides a reference voltage of the logic system. A terminal DiA is a terminal for two diodes 150 serially connected to a terminal DiK. The two diodes 150 are positioned at the left and right sides of the recording head and are used for measuring an average temperature of the recording head.

As explained in the foregoing, the recording apparatus applies a heat pulse, which is a pulse-shaped voltage, across the heat generating resistors seg1 to seg128 of the recording head, thereby driving the heat generating resistors seg1 to seg128, whereby the heat generated by the heat generating resistors seg1 to seg128 induces a bubble generation in the nearby ink and the ink is discharged by a pressure of such bubble generation. Consequently, in the recording head of such recording apparatus, the discharge amount of the ink principally depends on the volume of the bubble generated in the ink. Since the volume of the generated bubble in the ink varies by the temperature of the ink in the vicinity of the heat generating resistors seg1 to seg128, a preheat pulse (first pulse voltage) which is a pulse of an energy level not causing ink discharge is applied prior to the application of a heat pulse (second pulse voltage) for ink discharge, and the surface temperature of the heat generating resistors seg1 to seg128 is regulated by the pulse width and the timing of such preheat pulse whereby discharged liquid droplets are made constant and the print quality is maintained.

FIG. 7 is a chart showing a change in the surface temperature of the heat generating resistors seg1 to seg128 at the ink discharge in a conventional recording apparatus, and a wave form of the pulse voltage applied to the heat generating resistors seg1 to seg128.

At a time $t_0$ when the preheat pulse is entered into the heat generating resistors, the surface temperature $T_0$ of the heat generating resistors seg1 to seg128 is same as the temperature of the recording head, namely an environmental temperature. Since the ink discharge amount varies depending on the temperature of the ink as explained in the foregoing, the recording apparatus is further equipped with control means for maintaining the environmental temperature $T_0$ constant, utilizing the sub heater 142 and the aforementioned temperature sensor.

In response to the application of the preheat pulse to the heat generating resistors seg1 to seg128 at the time $t_0$, the surface temperature of the heat generating resistors seg1 to seg128 which has been $T_0$ same as the room temperature is elevated. When the application of the preheat pulse is terminated at a time $t_1$, the surface temperature of the heat generating resistors seg1 to seg128 which has reached a temperature $T_1$ starts to descend. Since the temperature $T_1$ is lower than 300° C. which is a bubble generating temperature of the ink, no bubble generation takes place in the ink up to this point. When a heat pulse is applied to the heat generating resistors at a time $t_2$, the surface temperature of the heat generating resistors seg1 to seg128 which has descended to a temperature $T_2$ starts to rise again. At a time $t_3$ when the surface temperature of the heat generating resistors seg1 to seg128 reaches $T_3$ (=300° C.), a bubble generation takes place in the ink. Upon the bubble generation, the heat is no longer transmitted from the heat generating resistors seg1 to seg128 to the ink, so that the surface temperature of the heat generating resistors seg1 to seg128 rises rapidly. Such temperature reaches a peak value $T_4$ at a time $t_4$ when the application of the heat pulse to the heat generating resistors seg1 to seg128 is terminated. After the time $t_4$ when the application of the heat pulse to the heat generating resistors seg1 to seg128 is terminated, since the thermal energy is no longer generated from the heat generating resistors seg1 to seg128, the surface temperature of the heat generating resistors seg1 to seg128 is rapidly lowered and returns to the original environmental temperature $T_0$. A pulse width of the preheat pulse is represented by $P_1$, a predetermined off time from the termination of the application of the preheat pulse to the start of the application of the heat pulse is represented by $P_2$, and a pulse width of the heat pulse is represented by $P_3$.

It is confirmed that the ink discharge amount varies significantly by the lengths of the pulse width $P_1$ and the off time $P_2$. FIG. 8 is a chart showing the relationship between the pulse width $P_1$ and the ink discharge amount when the environmental temperature $T_0$, the off time $P_2$ and the pulse width $P_3$ of the heat pulse are maintained constant.

In FIG. 8, curves a, b and c respectively represent the relation between the preheat pulse width $P_1$ and the ink discharge amount in recording heads different in the structure or in the driving conditions. $V_0$ indicates an ink discharge amount at $P_1$=0 μs. In a recording head represented by the curve a, in response to an increase in the preheat pulse width $P_1$, the ink discharge amount $V_d$ increases with a linearity in a range of the pulse width $P_1$ from 0 to $P_{1LMT}$, but loses the linearity of the change in a range where the pulse width $P_1$ is larger than $P_{1LMT}$ and reaches a saturated maximum at a pulse width $P_{1MAX}$. A range up to the pulse width $P_{1LMT}$, where the discharge amount $V_d$ shows a linear change with respect to the change of the pulse width $P_1$, is an effective range enabling an easy control of the discharge amount by the change of the pulse width $P_1$. In case the pulse width is larger than $P_{1MAX}$, the discharge amount $V_d$ becomes smaller than $V_{MAX}$. This is due to a phenomenon that, when a preheat pulse of a pulse width within the aforementioned range is applied, a small bubble (a state immediately before a film boiling) is generated on the heat generating resistor and a next heat pulse is applied before such small bubble is extinguished whereby such small bubble disturbs the bubble generation by the heat pulse, thereby resulting in a smaller discharge amount. Such range is called a prebubbling range, in which a discharge amount control by means of the preheat pulse as explained later becomes difficult. In FIG. 8, a preheat pulse dependence coefficient $K_p$, defining the inclination of a linear line indicating the relationship between the discharge amount within a range $P_1$=0 to $P_{1LMT}$ μs, is given by:

$$K_p = \Delta V_{dP} / \Delta P_1 (ng/\mu sec \cdot dot)$$

This coefficient $K_p$ is independent from the temperature and is determined by the structure and the drive conditions of the recording head, and the physical properties of the ink. As explained in the foregoing, the curves b and c in FIG. 8 indicate the preheat pulse depending characteristics of other recording heads, and it will be understood that the discharge characteristics become different for different recording heads. Also the upper limit $P_{1LMT}$ of the preheat pulse width $P_1$ is different for the different recording heads. As a reference, in the recording head and the ink represented by the curve a, $K_p$ is 3.209 (ng/μsec·dot).

FIG. 9 is a chart showing a relationship between the off time $P_2$ and the ink discharge amount when the environmental temperature $T_0$, the preheat pulse width $P_1$ and the heat pulse width $P_3$ are maintained constant. As shown in FIG. 9, within a range up to a value $P_{2MAX}$ which is determined by the head structure and the physical properties of the ink, the ink discharge amount $V_d$ increases with an increase in the off time $P_2$. This is because, with a longer off time $P_2$, the energy given to the ink at the application of the heat pulse can diffuse more sufficiently in the ink. When the off time exceeds $P_{2MAX}$, the ink discharge amount $V_d$ decreases with an increase in the off time $P_2$. This is because an excessively long off time $P_2$ loses the effect of increasing the ink discharge amount by the application of the preheat pulse.

On the other hand, with respect to an energy required for causing bubble generation in the liquid in contact with the aforementioned heat generating resistors seg1 to seg128, such energy is given by a product of an energy required for a unit area of the heat generating resistors seg1 to seg128 and the area of the heat generating resistors seg1 to seg128. Consequently, in order to obtain a desired ink discharge amount, there are required, as conditions for generating the energy required for discharging the desired amount of ink, in addition to a required area of the heat generating resistors seg1 to seg128, a voltage to be applied across the heat generating resistors seg1 to seg128, a current in the heat generating resistors seg1 to seg128 and a time thereof.

However, in a configuration where the heat generating resistors seg1 to seg128 are formed on an element substrate, the film thickness of the heat generating resistors seg1 to seg128 shows a fluctuation among produced recording head because of the manufacturing process of the recording head, so that the resistance of the heat generating resistors seg1 to seg128 shows a fluctuation of about ±20% among the recording heads, taking, as a standard, a resistance when the heat generating resistors have a film thickness as designed. Stated differently, even in case of producing plural recording heads of a same type, the resistance of the heat generating resistors seg1 to seg128 fluctuates from head to head. Consequently, though the voltage applied to the heat generating resistors seg1 to seg128 can be made substantially constant by a power supply in a main body of the printing apparatus, the current flowing in the heat generating resistors seg1 to seg128 becomes different from head to head because of the fluctuation in the film thickness of the heat generating resistors seg1 to seg128. In case the current becomes smaller by a resistance of the heat generating resistors seg1 to seg128 larger than the standard value, the volume of the bubble generated in the ink becomes smaller because of a deficiency in the charged energy. On the other hand, in case the current becomes larger by a resistance of the heat generating resistors seg1 to seg128 smaller than the standard value, the volume of the bubble generated in the ink becomes larger because of an excess in the charged energy. Stated differently, in case the resistance of the heat generating resistors seg1 to seg128 fluctuates among the recording heads, an error is generated in the ink discharge amount in each recording head, even if a same pulse voltage is given for a same time to all the recording heads.

For solving such drawback, there is conventionally adopted a method, utilizing the characteristics of the ink discharge amount shown in FIGS. 8 and 9, of changing the set value of the preheat pulse width $P_1$, the off time $P_2$ and the heat pulse width $P_3$ for each head, according to the resistance of the heat generating resistors seg1 to seg128.

As shown in FIG. 6, the element substrate is provided, separately from the heat generating resistors seg1 to seg128, with a rank resistor 141 for recognizing the resistance of the heat generating resistors seg1 to seg128. Conventionally, in adjusting the preheat pulse width $P_1$, the off time $P_2$ and the heat pulse width $P_3$, there is adopted a method of measuring the resistance of the rank resistor 141, referring to a rank table to be explained later based on the measured value and setting values $P_1$, $P_2$ and $P_3$ corresponding to the rank of the resistance of the rank resistor 141 as the preheat pulse width $P_1$, the off time $P_2$ and the heat pulse width $P_3$ of such recording head.

FIG. 10 shows a rank table to be used for determining the preheat pulse width $P_1$, the off time $P_2$ and the heat pulse width $P_3$. This rank table is for a recording head in which the rank resistor has a standard resistance of about 1044 to 1057 Ω and a fluctuation within a range of 884 to 1228 Ω. In this rank table, the resistance of 884 to 1228 Ω of the rank resistor is divided into 24 ranks, and a preheat pulse width $P_1$, an off time $P_2$ and a heat pulse width $P_3$ are set for each rank. As shown in the rank table in FIG. 10, the off time $P_2$ is fixed in all the ranks, in order to obtain, in all the ranks, a constant diffusion state in the ink of the thermal energy given by the application of the preheat pulse. As the resistance of the rank resistor 141 becomes smaller, the current in the heat generating resistors seg1 to seg128 will become larger, so that the preheat pulse width $P_1$ and the heat pulse width $P_3$ are selected shorter, and, as the resistance of the rank resistor 141 becomes larger, the current in the heat generating resistors seg1 to seg128 will become smaller, so that the preheat pulse width $P_1$ and the heat pulse width $P_3$ are selected longer. The preheat pulse width $P_1$ in the rank table is so selected as to reach the aforementioned temperature $T_1$ in each recording head.

Recently, in the recording apparatus utilizing the aforementioned recording head, there is shown a tendency of reducing the total pulse width of the preheat pulse and the heat pulse, in order to achieve a higher speed in the recording. A reduction in the pulse width of these pulses provides an advantage of reducing the amount of heat radiation from the heat generating resistors and also an advantage that the stability of the discharge state is increased because the ink temperature rises uniformly. The total pulse width of the preheat pulse and the heat pulse has conventionally been 3.5 to 5.5 μs, but is recently as short as 3 μs or less.

FIG. 11 is a chart showing a relationship between the total pulse width of the preheat pulse and the heat pulse, and the ink discharge amount. It will be seen that the ink discharge amount is almost constant within a range of 7.5 to 8.3 ng when the total pulse width of the preheat pulse and the heat pulse is within a range of 3.5 to 5.5 μs, but the ink discharge amount decreases rapidly with a reduction in the pulse width, in case the total pulse width is 3 μs or less.

In the rank table shown in FIG. 10, the preheat pulse width $P_1$, the off time $P_2$ and the heat pulse width $P_3$ are selected on a condition that the ink discharge amount is substantially constant irrespective of the total pulse width of the preheat pulse and the heat pulse selected on the rank table, and, in such a case that the ink discharge amount shows a rapid change by the total pulse width of the preheat pulse and the heat pulse, the ink discharge amount will eventually change even if the values in the rank table are merely applied.

In the conventional recording apparatus, as explained in the foregoing, the ink discharge amount shows a rapid decrease as the total pulse width of the preheat pulse and the heat pulse is decreased.

However, the tank table, to be referred to for determining the preheat pulse width, the off time and the heat pulse width for each produced recording head, is prepared on a condition that the ink discharge amount is almost constant irrespective of the total pulse width of the preheat pulse and the heat pulse. Consequently, even if the preheat pulse width and the heat pulse width are set at the values given in the rank table, the ink discharge amount shows a rapid decrease in case the total pulse width of the preheat pulse and the heat pulse is short, whereby encountered is a drawback that the ink discharge amount shows fluctuation among the recording heads.

SUMMARY OF THE INVENTION

In consideration of the foregoing, the object of the present invention is to provide a recording apparatus and a discharge method therefor, capable of obtaining a constant ink discharge amount among the recording heads, even in case the total pulse width of pulse voltages applied to heat generating resistors.

The above-mentioned object can be attained, according to the present invention, by a recording apparatus including:

a recording head having a semiconductor substrate in which formed is a heat generating resistor for converting electric energy into thermal energy, for providing a liquid with the thermal energy to generate a bubble in the liquid thereby discharging the liquid for recording on a recording medium; and a control circuit which controls the recording head, at the discharge of the liquid, in such a manner as to apply a first pulse voltage to the heat generating resistor to heat the liquid in the vicinity of the heat generating resistor and, after the lapse of a predetermined time, to apply a second pulse voltage to the heat generating resistor to generate the bubble thereby discharging the liquid, and which sets the pulse width of the first pulse voltage, the pulse width of the second pulse voltage and the predetermined time by referring to a rank table showing a relationship between a resistance of a rank resistor corresponding to the resistance of the heat generating resistor and the pulse width of the first pulse voltage, the predetermined time and the pulse width of the second pulse voltage;

wherein the control circuit sets the pulse width of the first pulse voltage, based on a rank table in which the pulse width of the first pulse voltage is set in such a manner that a maximum reached temperature of a surface of the heat generating resistor at the application of the first pulse voltage becomes higher as the resistance of the rank resistor becomes smaller.

In the recording apparatus of the present invention, the rank table is set in such a manner that the maximum reached temperature of the heat generating resistor at the application of the first pulse voltage becomes higher as the resistance of the heat generating resistor becomes smaller, so that the pulse width of the first pulse voltage can be made longer than the pulse width of the first pulse voltage in a conventional recording head having a same resistance in the heat generating resistor. Therefore, even in a situation where the ink discharge amount decreases with a decrease in the total pulse width of the first pulse voltage and the second pulse voltage, the recording apparatus of the present invention, utilizing the characteristics that the liquid discharge amount increases with a prolongation of the first pulse voltage, extends the pulse width of the first pulse voltage beyond the value in the conventional configuration, thereby compensating the decrease in the ink discharge amount. Consequently, the recording apparatus of the present invention can maintain a constant ink discharge amount among the recording heads, even in case the total pulse width of the pulse voltage applied to the heat generating resistor is reduced.

Also in the recording apparatus of the present invention, the predetermined time in the aforementioned rank table is preferably constant regardless of the resistance of the rank resistor.

Another recording apparatus of the present invention includes:

a recording head having a semiconductor substrate in which formed is a heat generating resistor for converting electric energy into thermal energy, for providing a liquid with the thermal energy to generate a bubble in the liquid thereby discharging the liquid for recording on a recording medium; and a control circuit which controls the recording head, at the discharge of the liquid, in such a manner as to apply that a first pulse voltage to the heat generating resistor to heat the liquid in the vicinity of the heat generating resistor and, after the lapse pf a predetermined time, to apply a second pulse voltage to the heat generating resistor to generate the bubble thereby discharging the liquid, and which set the pulse width of the first pulse voltage, the pulse width of the second pulse voltage and the predetermined time by referring a rank table showing a relationship between a resistance of a rank resistor corresponding to the resistance of the heat generating resistor and the pulse width of the first pulse voltage, the predetermined time and the pulse width of the second pulse voltage;

wherein the control circuit sets the predetermined time, by referring to a rank table in which the predetermined time is set in such a manner as to become longer as the resistance of the rank resistor becomes smaller.

In the recording apparatus of the present invention, the rank table is so set that the predetermined time from the end of application of the first pulse voltage to the start of application of the second pulse voltage becomes longer as the resistance of the heat generating resistor becomes smaller. Therefore, the recording apparatus of the present invention, even in a situation where the liquid discharge amount decreases with a decrease in the sum of the pulse widths of the first pulse voltage and the second pulse voltage, utilizing the characteristics that the liquid discharge amount increases with an elongation of the predetermined time, extends the predetermined time longer than in the conventional configuration, thereby increasing the liquid discharge amount and compensating the decrease in the liquid discharge amount. Consequently, the recording apparatus of the present invention can provide a constant liquid discharge amount among the recording heads, even when the total pulse width of the pulse voltages applied to the heat generating resistor.

Preferably the recording apparatus of the present invention is further provided with temperature control means for maintaining the environmental temperature constant.

Also, in the recording apparatus of the present invention, the recording head is further provided with plural discharge ports for discharging the liquid, and a member constituting plural liquid flow paths communicating with the discharge ports. Further, the recording apparatus of the present invention is provided with drive signal supply means for supplying the recording head with a drive signal for driving the recording head, and recording medium conveying means for conveying a recording medium to be printed by the recording head.

In the aforementioned configuration of the present invention, the rank table is set in such a manner that the maximum reached temperature of the heat generating resistor at the application of the first pulse voltage becomes higher as the resistance of the heat generating resistor becomes smaller, so that the pulse width of the preheat pulse can be made longer than the pulse width of the preheat pulse in a conventional recording apparatus having a same resistance in the heat generating resistor. Therefore, even in a situation where the ink discharge amount decreases with a decrease in the total pulse width of the preheat pulse and the heat pulse, the recording apparatus of the present invention, utilizing the characteristics that the liquid discharge amount increases with a prolongation of the preheat pulse, extends the pulse width of the preheat pulse beyond the value in the conventional configuration, thereby compensating the decrease in the ink discharge amount. Consequently, the ink discharge amount among the recording heads can be maintain constant, even in case the total pulse width of the pulse voltage applied to the heat generating resistor is reduced.

BRIEF DESCRIPTION OF THE DRAWINGS

FIG. 3 is a table showing an example of a rank table prepared according to a pulse width setting method for the preheat pulse in a recording apparatus embodying the present invention;

FIG. 10 is a rank table to be used in setting the pulse width of a preheat pulse, an off time width and the pulse width of a heat pulse.

DETAILED DESCRIPTION OF THE PREFERRED EMBODIMENTS

In the following, an embodiment of the recording apparatus of the present invention will be explained in detail with reference to the accompanying drawings. Since the ink discharge amount is significantly influenced also by an environmental temperature such as the ink temperature as explained in the foregoing, the recording apparatus of the present embodiment is further provided, as in the conventional configuration, with control means for maintaining the environmental temperature $T_0$ constant utilizing the sub heater 142 and the aforementioned temperature sensor, and the following description will be made on an assumption that the environmental temperature $T_0$ is constant.

Figure 6:
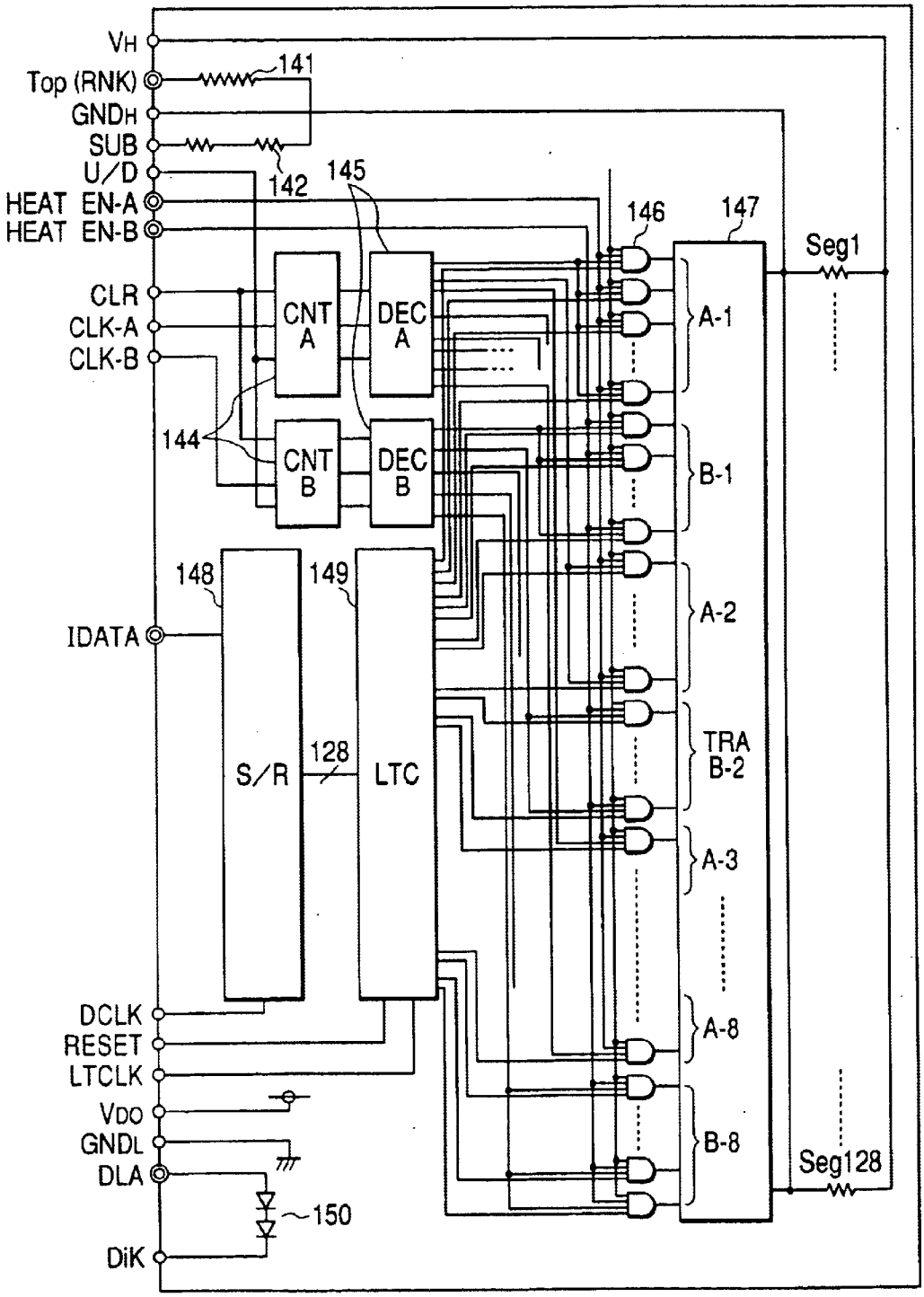
FIG. 6 is a block diagram showing an example of a driver formed on an element substrate.

In a recording head of the recording apparatus of the present embodiment, there is formed a rank resistor 141 for measuring the resistance of the heat generating resistors seg1 to seg128 shown in FIG. 6, as in the conventional recording apparatus, and, also in the recording apparatus of the present embodiment, a control circuit for controlling the recording head at the ink discharge in such a manner as to apply a preheat pulse to the heat generating resistors seg1 to seg128 thereby heating the liquid in the vicinity of the heat generating resistors seg1 to seg128, and, after the lapse of a predetermined time, to apply a heat pulse to the heat generating resistors seg1 to seg128 thereby generating a bubble to discharge the liquid, refers to a rank table indicating the relationship between the resistance of the rank resistor 141 corresponding to the resistance of the heat generating resistors seg1 to seg128 and the pulse width $P_1$ of the preheat pulse, the off time width $P_2$ and the pulse width $P_3$ of the heat pulse, thereby setting the preheat pulse width $P_1$, the heat pulse width $P_3$ and the off time $P_2$, in order to absorb the error in the ink discharge amount among the produced recording heads.

In the recording apparatus of the present embodiment, the preheat pulse width $P_1$ on the rank table is so set that the maximum reached temperature of the surface of the heat generating resistors seg1 to seg128 when heated by the preheat pulse becomes higher as the resistance of the heat generating resistors seg1 to seg128 becomes smaller. Stated differently, in the recording apparatus of the present embodiment, the method of setting the preheat pulse width $P_1$ in the rank table is different from that in the conventional recording apparatus.

Figure 1:
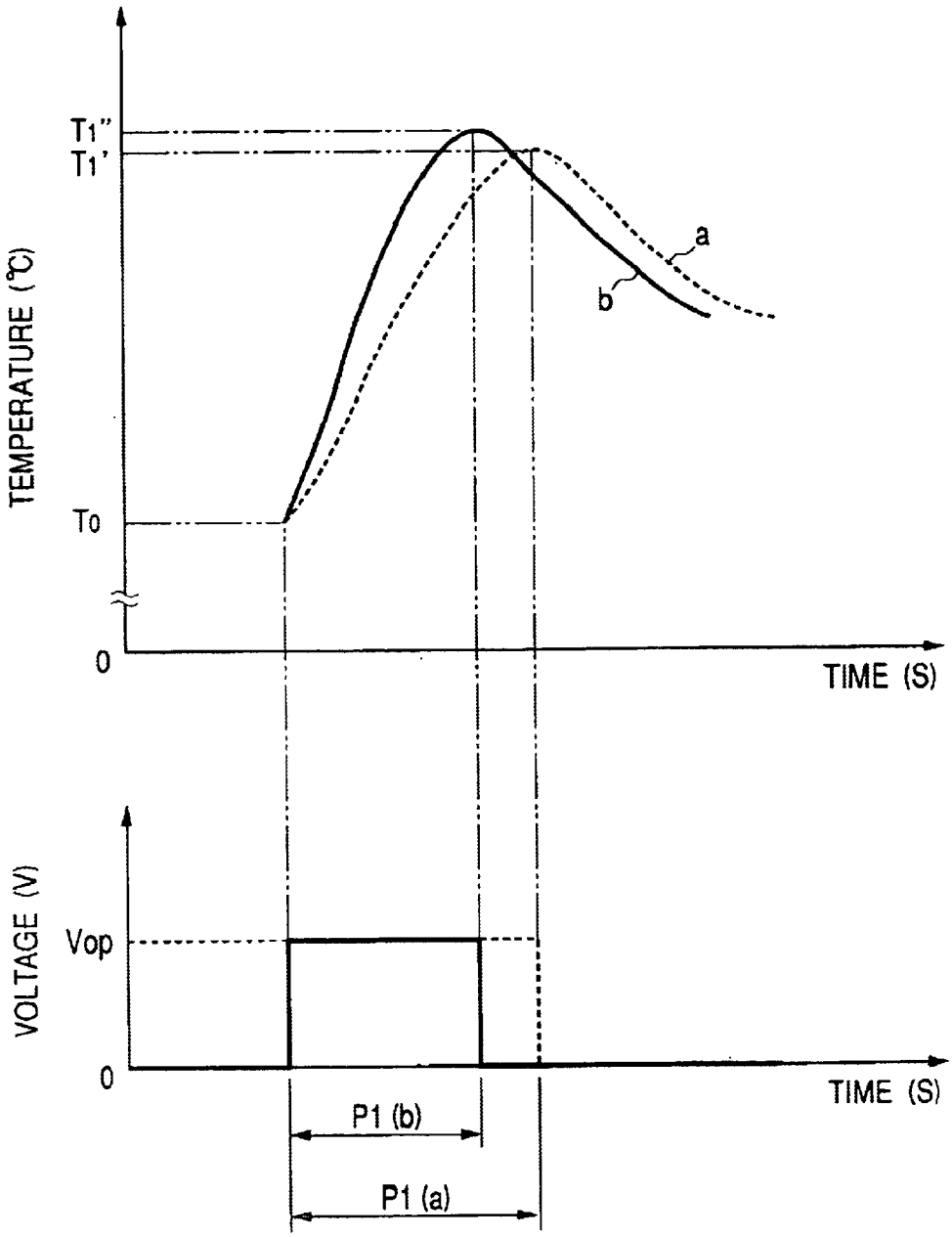
FIG. 1 is a chart showing, in a recording apparatus embodying the present invention, a change in the surface temperature of a heat generating resistor of the recording apparatus at the ink discharge and a wave form of a pulse voltage entered into the heat generating resistor.

FIG. 1 is a chart showing, in the recording apparatus of the present embodiment, a mode of change of the surface temperature of the heat generating resistors seg1 to seg128 of the recording apparatus at the ink discharge, and a wave form of a pulse voltage entered into the heat generating resistors seg1 to seg128. A curve a in FIG. 1 shows the change in the surface temperature of the heat generating resistors at the application of the preheat pulse, in case the resistance of the heat generating resistors seg1 to seg128 is relatively large, and a curve b shows the change in the surface temperature of the heat generating resistors at the application of the preheat pulse, in case the resistance of the heat generating resistors seg1 to seg128 is relatively small.

Figure 7:
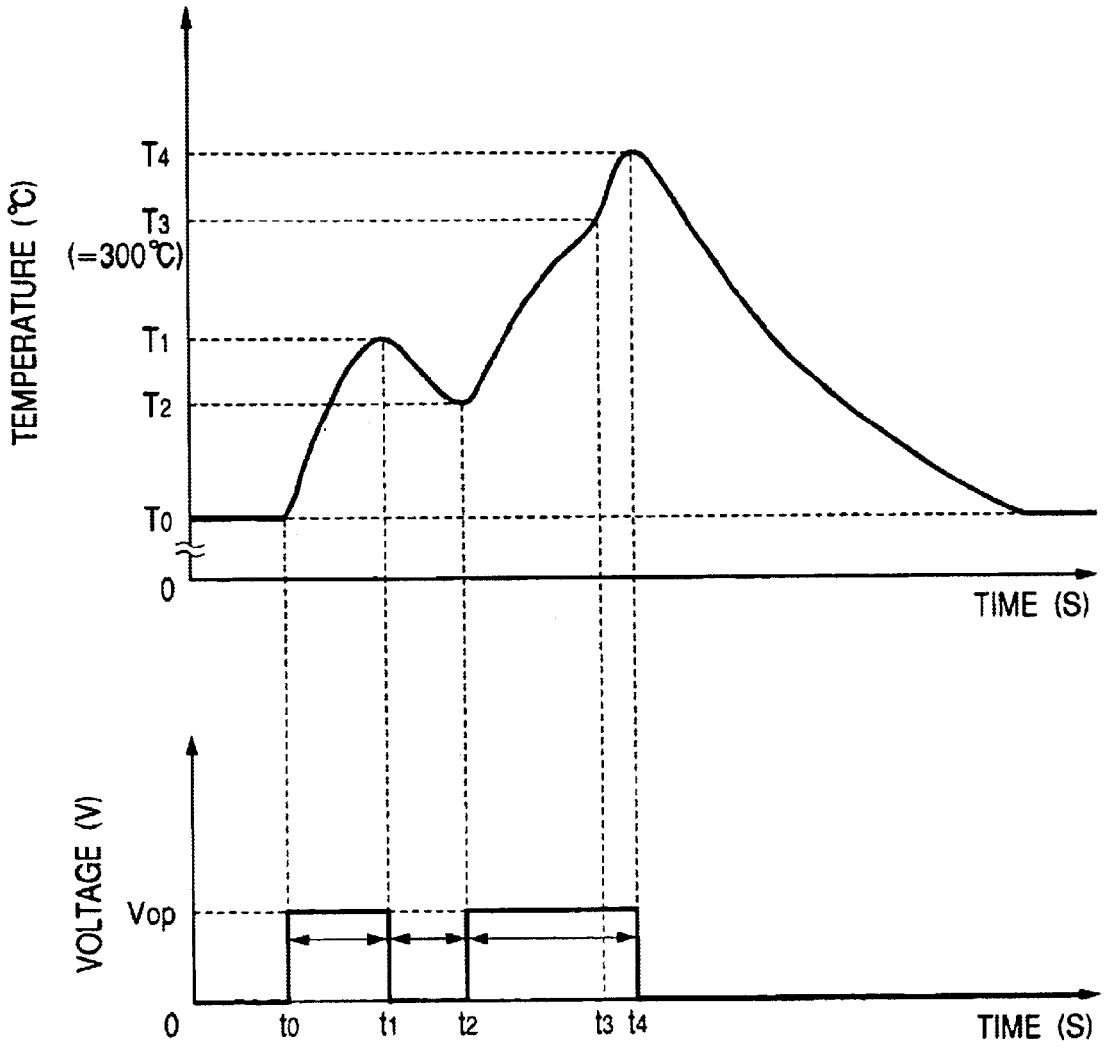
FIG. 7 (CONVENTIONAL ART)
FIG. 7 is a chart showing a change in the surface temperature of a heat generating resistor of a conventional recording head and a wave form of a pulse voltage applied to the heat generating resistor.

In the chart in FIG. 7 for a conventional recording apparatus, the maximum reach temperature of the surface of the heat generating resistors seg1 to seg128 at the application of the preheat pulse $P_1$ is constant at $T_1$ regardless of the resistance of the heat generating resistors, but, in the recording apparatus of the present embodiment, the maximum reached temperature $T_1''$ of the surface of the heat generating resistors seg1 to seg128 at the application of the preheat pulse $P_1$ on the curve b is higher than the maximum reached temperature $T_1'$ on the surface of the heat generating resistors seg1 to seg128 at the application of the preheat pulse $P_1$ on the curve a.

Figure 8:
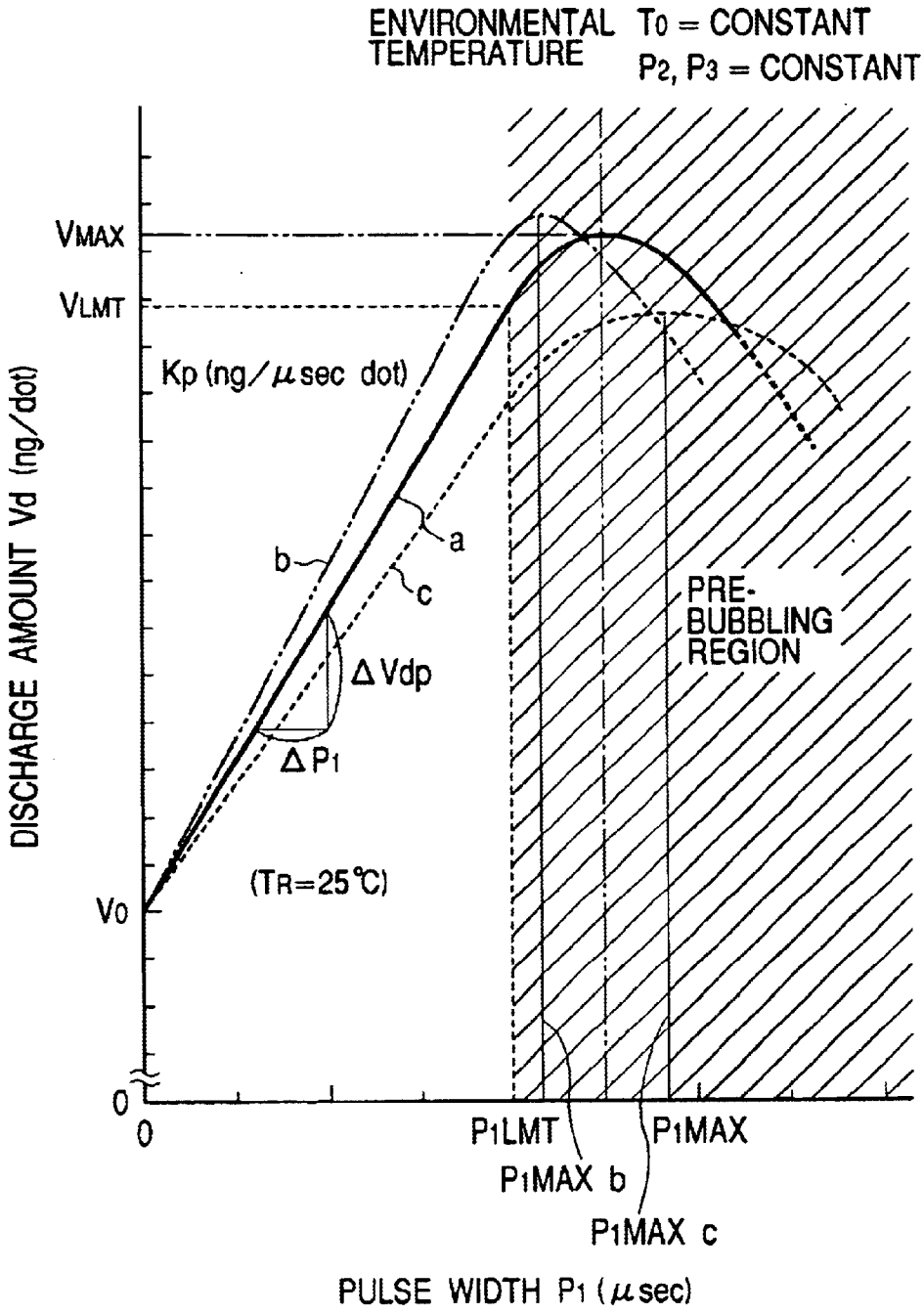
FIG. 8 (CONVENTIONAL ART)
FIG. 8 is a chart showing the relationship between the pulse width of a preheat pulse and the ink discharge amount when an environmental temperature, an off time width and the pulse width of a heat pulse are maintained constant.

In the recording apparatus of the present embodiment, as explained in the foregoing, the maximum reached temperature of the heat generating resistors seg1 to seg128 at the application of the preheat pulse is so set as to become higher as the resistance of the heat generating resistors seg1 to seg128, or the resistance of the rank resistor 141, becomes smaller. In the recording apparatus of the present embodiment, the maximum reached temperature is set higher as the resistance of the heat generating resistors seg1 to seg128 becomes smaller, whereby the preheat pulse width $P_1$ can be made longer than the preheat pulse width $P_1$ in a conventional recording apparatus having a same resistance in the heat generating resistors seg1 to seg128. Therefore, even in a situation where the ink discharge amount decreases with a decrease in the sum of the pulse widths $P_1$, $P_2$ of the preheat pulse and the heat pulse, the recording apparatus of the present embodiment, utilizing the characteristics that the ink discharge amount increases with an increase in the preheat pulse width $P_1$ as shown in FIG. 8, extends the preheat pulse width $P_1$ in excess of the value in the conventional configuration, thereby increasing the ink discharge amount in comparison with the conventional configuration and compensating the decrease in the ink discharge amount. Consequently the recording apparatus of the present embodiment can maintain a constant ink discharge amount among the recording heads, even in case the total pulse width applied to the heat generating resistors seg1 to seg128 becomes shorter.

Figure 2:
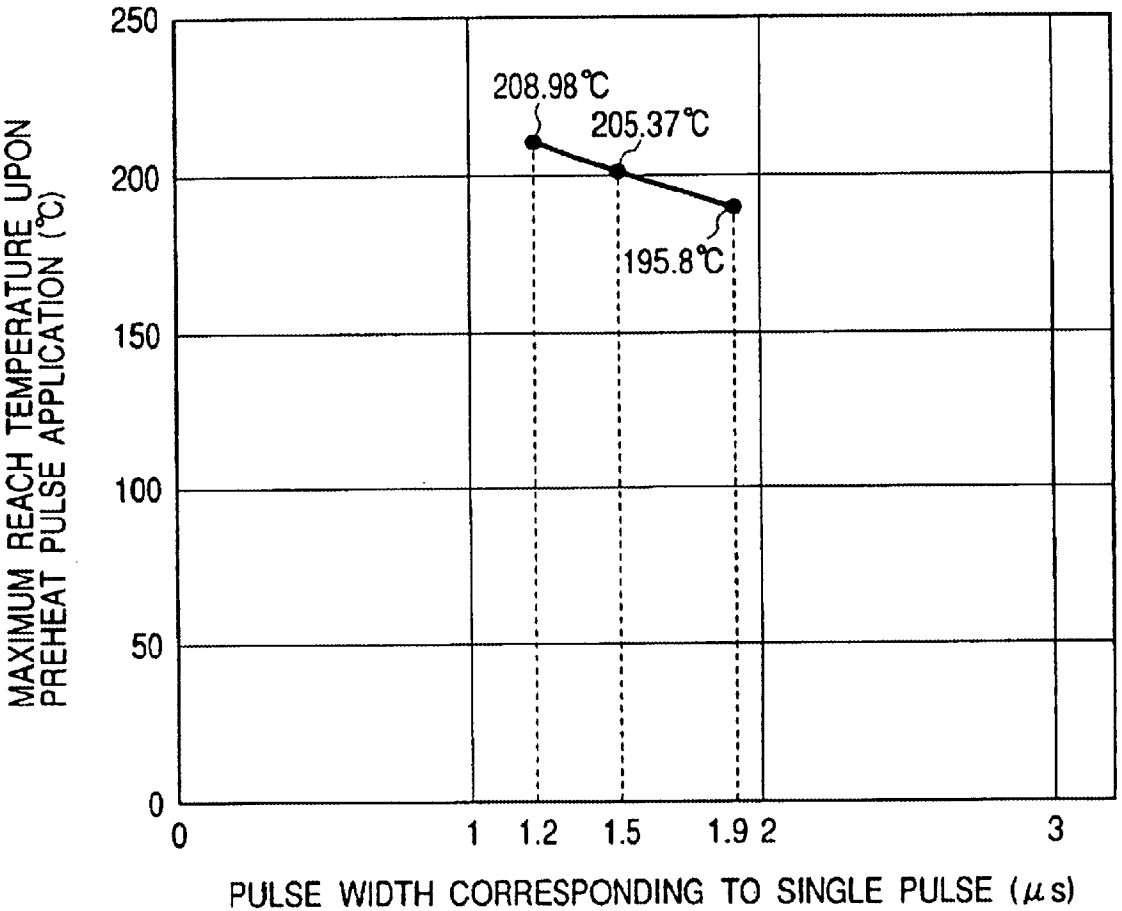
FIG. 2 is a chart showing, in a recording apparatus embodying the present invention, the relationship between a pulse width corresponding to a single pulse at each value of a rank resistor and a maximum reached temperature at the surface of the heat generating resistor at the application of a preheat pulse.

In the following there will be given a detailed explanation on the method of setting the preheat pulse width $P_1$ of the rank table in the recording apparatus of the present embodiment. As an example, in the recording apparatus of the present embodiment, it is assumed that the rank resistor 141 has a standard resistance of about 535 to 544 Ω, and a fluctuation in the resistance of 435 to 654 Ω. FIG. 2 is a chart showing an example of the relationship, in the recording apparatus of the present embodiment, between a pulse width corresponding to a single pulse at the resistance of the rank resistor 141 and the maximum reached temperature of the surface of the heat generating resistors seg1 to seg128 when the preheat pulse is applied.

In FIG. 2, the abscissa indicates the pulse width corresponding to a single pulse, while the ordinate indicates the maximum reached temperature of the surface of the heat generating resistors seg1 to seg128 under the application of the preheat pulse. The pulse width corresponding to a single pulse means a pulse width required, at the application of a single pulse to the heat generating resistors seg1 to seg128 of the recording head, to reach a bubbling temperature for generating a bubble in the ink in the vicinity of the heat generating resistors seg1 to seg128. This pulse width corresponding to the single pulse is also determined by the resistance of the heat generating resistors seg1 to seg128, namely the resistance of the rank resistor 141. It is assumed, in the recording apparatus of the present embodiment, that the pulse width corresponding to the single pulse is 1.5 μs in case the rank resistor has a standard resistance of 535 to 544 Ω, but is 1.2 μs in case the resistance of the rank resistor is 435 to 444 Ω, and is 1.9 μs in case the resistance of the rank resistor is 645 to 654 Ω.

In the method for setting the preheat pulse width $P_1$ in the recording apparatus of the present embodiment, at first the preheat pulse width $P_1$ is determined for a case where the rank resistor 141 has a standard resistance of 535 to 544 Ω. Such preheat pulse width $P_1$ preferably provides an ink discharge amount same as that in case the total pulse width is 3 μs or larger. The determination of the preheat pulse width $P_1$ automatically determines the maximum reached temperature of the surface of the heat generating resistors seg1 to seg128 at the application of the preheat pulse. In case the rank resistor 141 has the standard resistance of 535 to 544 Ω, namely in case the pulse width corresponding to the single pulse is 1.5 μs, the maximum reached temperature becomes 205.37° C. as shown in FIG. 2.

In the recording apparatus of the present embodiment, since the preheat pulse width on the rank table is set in such a manner that the maximum reached temperature of the surface of the heat generating resistors seg1 to seg128 becomes higher as the resistance of the heat generating resistors seg1 to seg128 becomes smaller, the relationship between the pulse width corresponding to the single pulse and the maximum reached temperature on the surface of the heat generating resistors seg1 to seg128 at the application of the preheat pulse assumes a form of a straight line becoming lower toward the right.

In the setting method for the preheat pulse width $P_1$ in the recording apparatus of the present embodiment, the inclination of the line is then determined. In the recording apparatus of the present embodiment, the line has such an inclination that the maximum reached temperature decreases by 5 to 15% with an increase by 1 μs in the pulse width corresponding to the single pulse. This inclination is determined by the structure and the drive conditions of the head and the physical properties of the ink. In FIG. 2, the inclination is so selected that the maximum reached temperature decreases by about 10% with an increase by 1 μs in the pulse width corresponding to the single pulse.

In the setting method for the preheat pulse width $P_1$ in the recording apparatus of the present embodiment, based on the aforementioned straight line prepared on FIG. 2, there is determined the maximum reached temperature on the surface of the heat generating resistors at the resistance in each rank of the rank table. For example, according to the straight line in FIG. 2, the maximum reached temperature becomes 208.98° C. in case the rank resistor has a resistance of 435 to 444 Ω (pulse width corresponding to single pulse=1.2 μs), and becomes 195.8° C. in case the rank resistor has a resistance of 645 to 654 Ω (pulse width corresponding to single pulse=1.9 μs). For each rank in the rank table, there is set a preheat pulse width $P_1$ so as to reach the maximum reached temperature determined from the straight line.

FIG. 3 shows an example of the rank table, prepared by the setting method for the preheat pulse width $P_1$ in the recording apparatus of the present embodiment.

As shown in FIG. 3, the resistance of 435 to 654 Ω of the rank resistor is divided into 22 ranks, and a preheat pulse width $P_1$, an off time $P_2$ and a heat pulse width $P_3$ are set for each rank. Among these, the preheat pulse width $P_1$ in each rank is determined, based on the straight line prepared by the aforementioned setting method for the preheat pulse width $P_1$ in the recording apparatus of the present embodiment as shown in FIG. 2, so as to reach the maximum reached temperature of the heat generating resistors seg1 to seg128 at the resistance of the rank resistor.

Since the ink discharge amount is also influenced by the off time $P_2$, the off time $P_2$ in each rank in the rank table is fixed at 2.375 μs as shown in FIG. 3. Also the setting method for the heat pulse width $P_3$ in the rank table shown in FIG. 3 is similar to that in the conventional configuration and will not be explained further.

Figure 9:
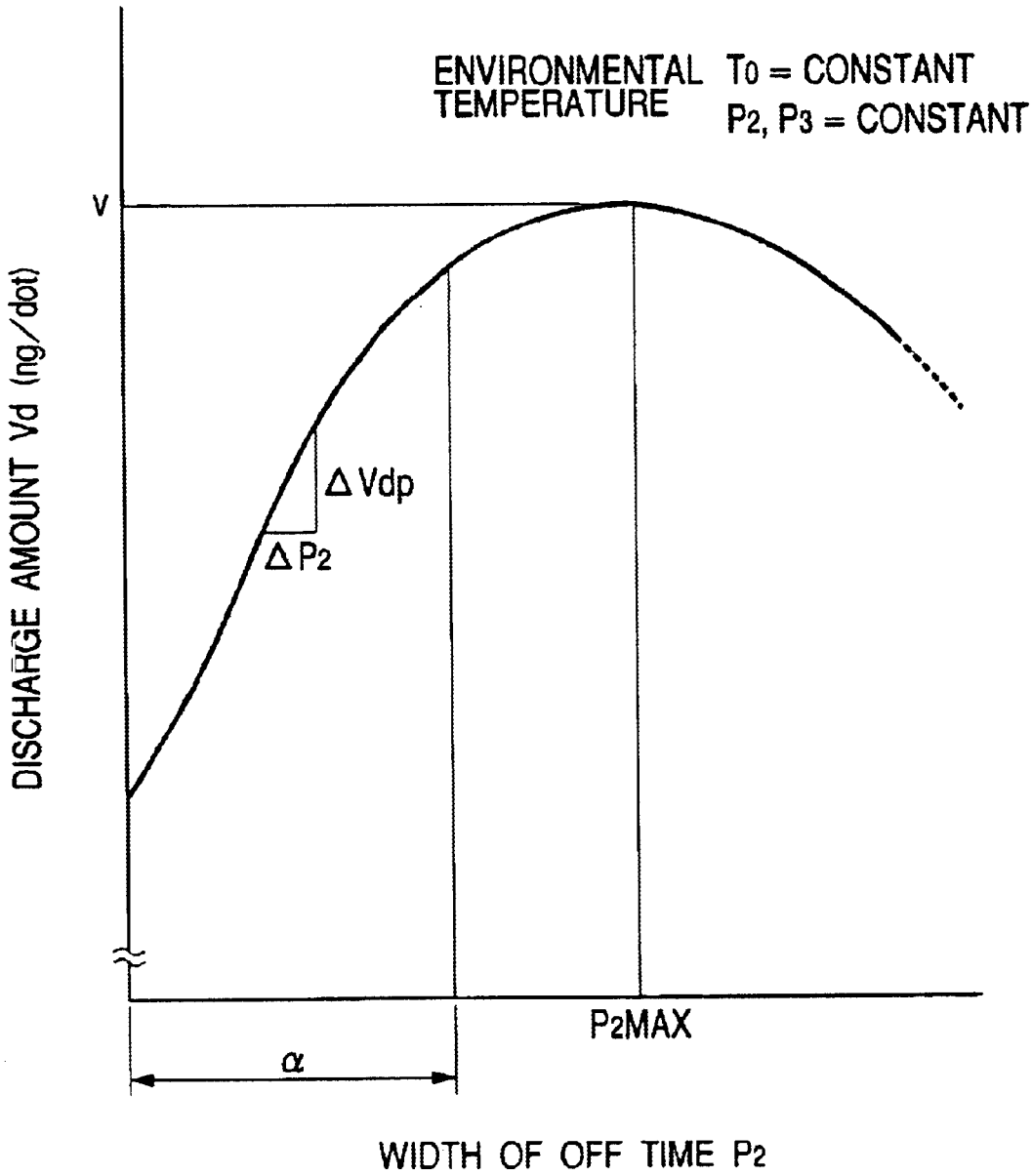
FIG. 9 (CONVENTIONAL ART)
FIG. 9 is a chart showing the relationship between the off time width and the ink discharge amount when an environmental temperature, the pulse width of a preheat pulse and the pulse width of a heat pulse are maintained constant.
Figure 11:
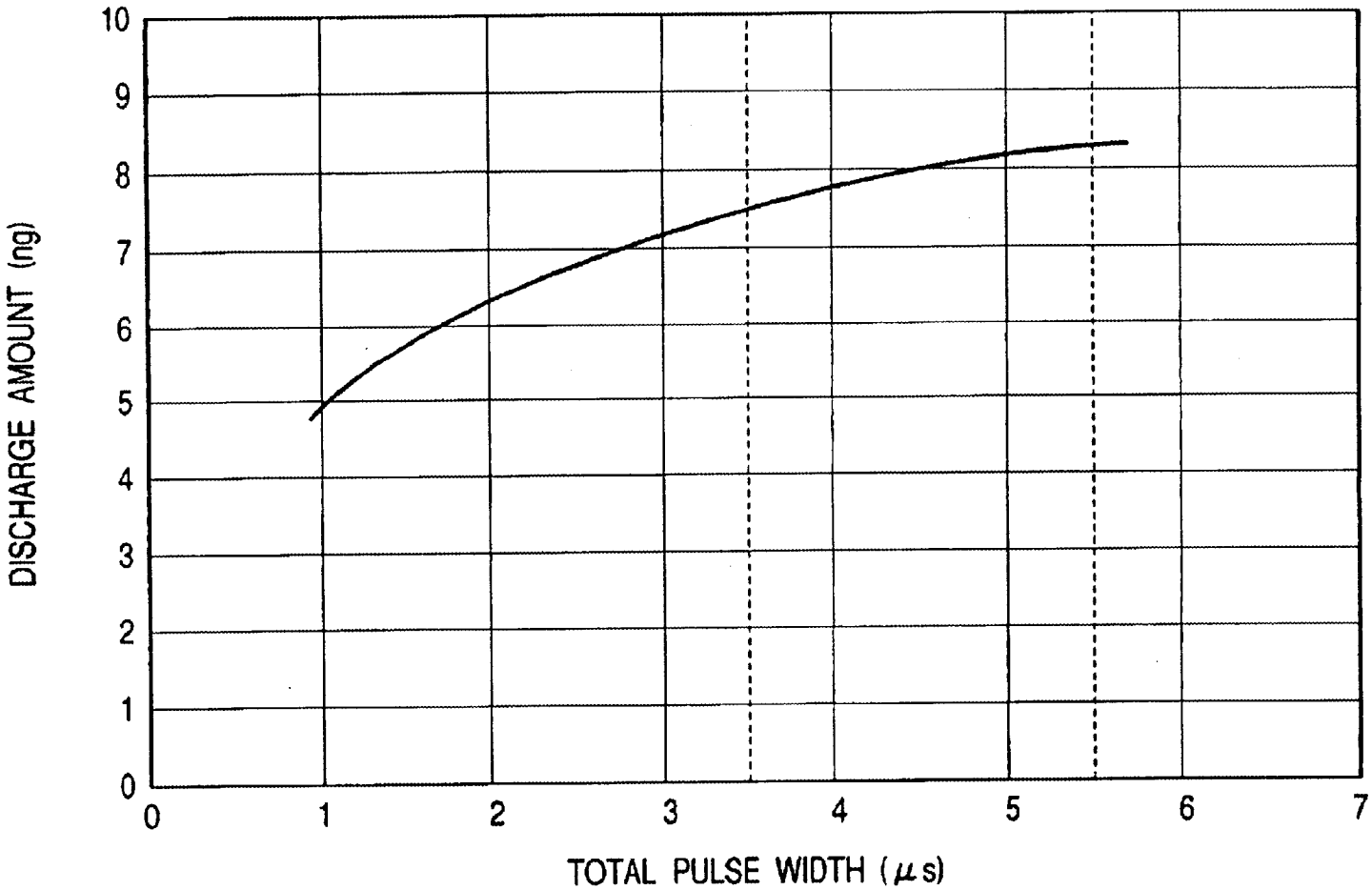
FIG. 11 (CONVENTIONAL ART)
FIG. 11 is a chart showing the relationship between a total pulse width of a preheat pulse and a heat pulse, and an ink discharge amount.

In the recording apparatus of the present embodiment, in order to obtain a constant ink discharge amount, the preheat pulse width $P_1$ is changed from the conventional value, utilizing the linear relationship between the ink discharge amount and the preheat pulse width $P_1$ shown in FIG. 8. The recording apparatus of the present invention is not limited to such embodiment, and it is also possible to obtain a constant ink discharge amount, instead of fixing the off time width $P_2$, by changing the off time $P_2$ together with the preheat pulse width $P_1$ from the conventional values utilizing a linear relationship between the ink discharge amount and the off time $P_2$ as shown in FIG. 9, or to obtain a constant ink discharge amount by changing the off time $P_2$ from the conventional value while maintaining the preheat pulse width $P_1$ fixed.

In case of obtaining a constant ink discharge amount by varying the off time $P_2$, the rank table is so set that the off time $P_2$ becomes longer as the resistance of the heat generating resistors seg1 to seg128, or the resistance of the rank resistor 141, becomes smaller.

Even in a situation where the ink discharge amount decreases with a decrease in the sum of the pulse widths of the preheat pulse and the heat pulse, the recording apparatus of the present embodiment, utilizing the characteristics that the ink discharge amount increases with an elongation of the off time $P_2$ as shown in FIG. 8, selects the off time $P_2$ set in the rank table longer than in the conventional configuration, thereby increasing the ink discharge amount larger than in the conventional configuration and compensating the decrease in the ink discharge amount. Consequently the recording apparatus of the present embodiment can maintain a constant ink discharge amount among the recording heads even if the total pulse width applied to the heat generating resistors seg1 to seg128 becomes shorter.

However, in setting the off time $P_2$ in the rank table, the off time $P_2$ to be set in the rank table has to be selected within a range of 0 to $P_{2MAX}$ μs in which the ink discharge amount increases with an increase in the off time $P_2$, and is preferably selected within a range α in which the relationship between the ink discharge amount and the off time $P_2$ is maintained with an inclination $\Delta V_{dp}/\Delta P_2$.

Figure 4:
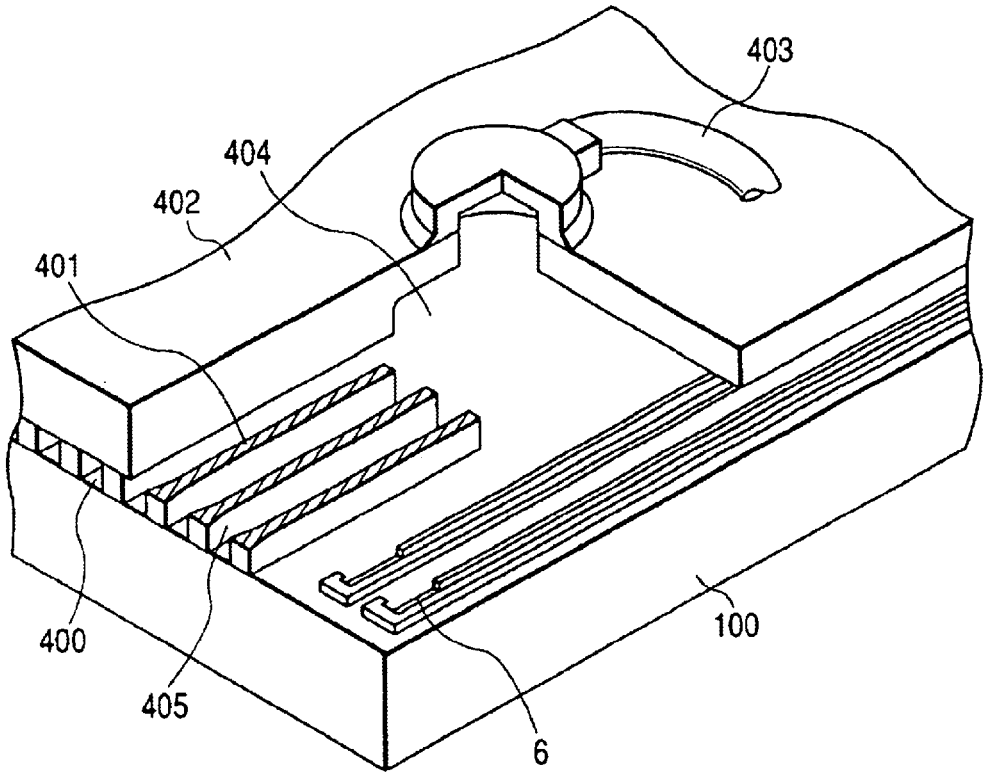
FIG. 4 is a perspective view showing the configuration of a recording head in a recording apparatus embodying the present invention.

FIG. 4 is a perspective view showing the configuration of a recording head of the recording apparatus of the present embodiment. As shown in FIG. 4, in the recording head, there are mounted a flow path wall member 401 for forming liquid flow paths 405 communicating with plural discharge ports 400, and a top plate 402 having an ink supply aperture 403. Ink supplied from the ink supply aperture 403 is stored in an internal common liquid chamber 404 and supplied to the liquid paths 405. In such state, the heat generating resistors 6 on a liquid discharge head substrate 100 are energized according to recording data to discharge the ink from the discharge ports 400 thereby executing recording.

In the foregoing there has been explained a case where the top plate 402 and the flow path wall member 401 are composed of separate members, but the top plate 402 and the flow path wall member 404 may be constituted by an integrally formed single member.

Figure 5:
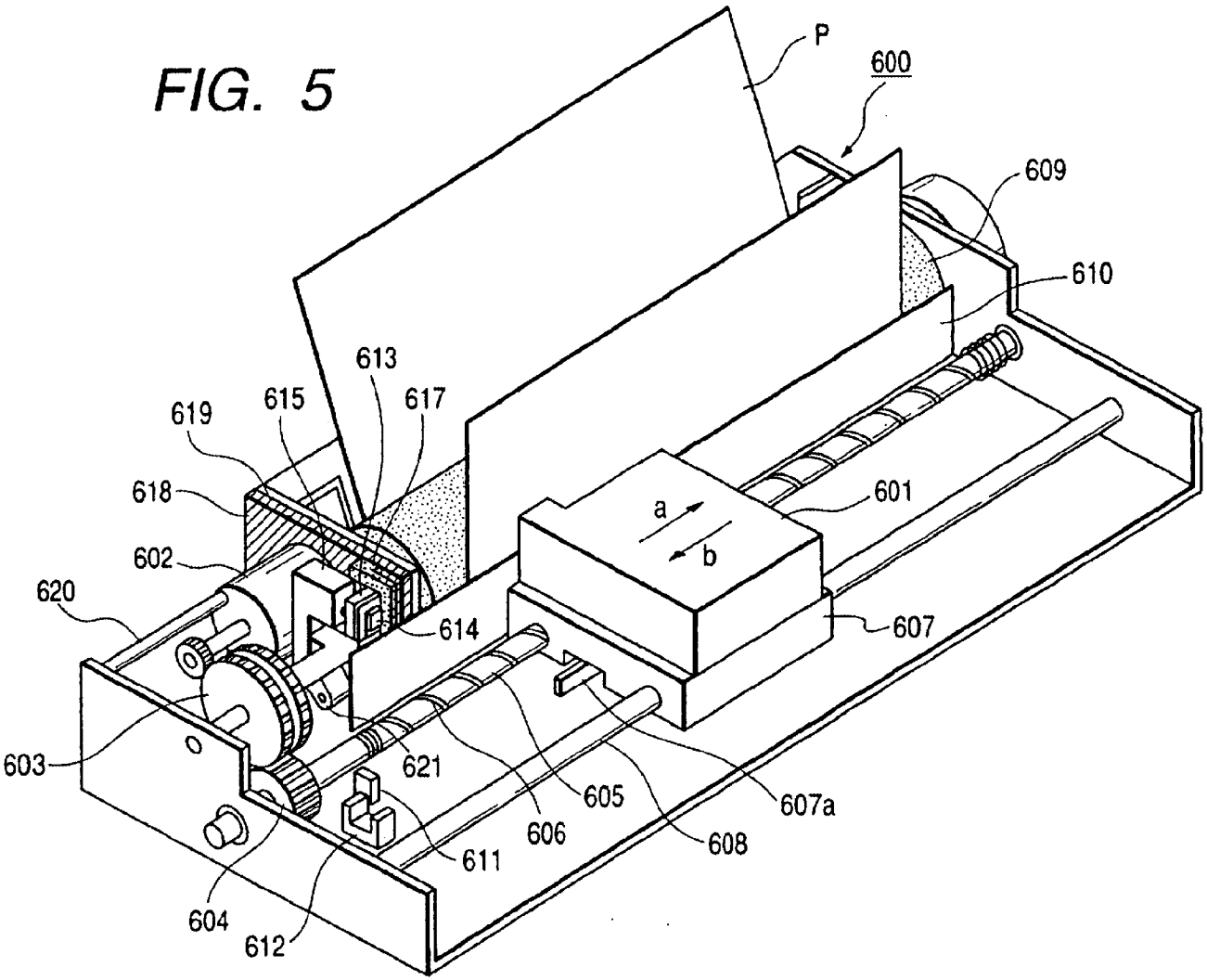
FIG. 5 is a schematic perspective view of an ink jet recording apparatus constituting an example of the recording apparatus embodying the present invention.

In the following there will be briefly explained the recording apparatus of the present embodiment, employing the aforementioned recording head. FIG. 5 is a schematic perspective view of an ink jet recording apparatus 600 constituting an example of the recording apparatus of the present embodiment.

Referring to FIG. 5, an ink jet head cartridge 601 is integrally composed of the aforementioned recording head and an ink tank for holding the ink to be supplied to the recording head. The ink jet head cartridge 601 is mounted on a carriage 607 which engages with a spiral groove 606 of a lead screw 605 rotated by forward or reverse rotation of a driving motor 602 through transmission gears 603, 604, and is reciprocated in directions a and b along a guide 608 together with the carriage 607, by the power of the driving motor 602. A recording material P is conveyed on a platen roller 609 by unrepresented recording material conveying means, and is pressed to the platen roller 609 by a pressure plate 610 over the moving direction of the carriage 607.

In the vicinity of an end of the lead screw 605, photocouplers 611, 612 are provided. These constitute home position detecting means for confirming the presence of a lever 607*a* of the carriage 607 in this area, thereby for example switching the rotating direction of the driving motor 602.

A support member 613 supports a cap member 614 for covering a front face including the discharge ports (discharge port face) of the aforementioned ink jet head cartridge 601. Ink suction means 615 is provided for sucking the ink emitted by a dummy discharge from the ink jet head cartridge 601 and accumulating in the interior of the cap member 614. The ink suction means 615 executes suction recovery of the ink jet head cartridge 601 through an aperture in the cap member. A cleaning blade 617 for wiping the discharge port face of the ink jet head cartridge 601 is provided movably in a front-and-back direction (perpendicular to the moving direction of the carriage 607) by a movable member 618. The cleaning blade 617 and the movable member 618 are supported by a support member 619 of the main body. The cleaning blade 617 is not limited to such form but may be composed of another known cleaning blade.

At the suction recovery operation of the recording head, a lever 620 for starting the suction is moved by a movement of a cam 621 engaging with the carriage 607, whereby the driving force of the driving motor 602 is transmitted by known transmission such as a switching clutch. An ink jet recording control unit, for supplying signals to the heat generating resistors of the recording head in the ink jet head cartridge 601 and controlling various mechanisms explained in the foregoing, is provided in the main body of the apparatus and is omitted from the illustration.

The ink jet recording apparatus 600 of the above-described configuration executes recording on the recording material P conveyed on the platen roller 609 by the unrepresented recording medium conveying means, by the reciprocating motion of the ink jet head cartridge 601 over the entire width of the recording material P. The ink jet recording apparatus 600 is further provided, though not illustrated, with drive signal supply means for supplying the recording head with a drive signal for causing ink discharge from the recording head.

What is claimed is:

1. A recording apparatus comprising:

a recording head including a semiconductor substrate in which is formed a heat generating resistor for converting electric energy into thermal energy, for providing a liquid with the thermal energy to generate a bubble in the liquid, thereby discharging the liquid for recording on a recording medium; and a control circuit which controls said recording head, at the discharge of the liquid, in such a manner as to apply a first pulse voltage to said heat generating resistor to heat the liquid in the vicinity of said heat generating resistor and, after a lapse of a predetermined time, to apply a second pulse voltage to said heat generating resistor to generate the bubble, thereby discharging the liquid, and which sets a pulse width of the first pulse voltage, a pulse width of the second pulse voltage and the predetermined time by referring to a rank table showing a relationship between a resistance of a rank resistor corresponding to a resistance of said heat generating resistor and the pulse width of the first pulse voltage, the predetermined time and the pulse width of the second pulse voltage;

wherein said control circuit sets the pulse width of the first pulse voltage, based on the rank table in which the pulse width of the first pulse voltage is set in such a manner that a maximum reached temperature of a surface of said heat generating resistor at an application of the first pulse voltage becomes higher as the resistance of said rank resistor becomes smaller.

2. A recording apparatus according to claim 1, wherein the predetermined time in the rank table is constant regardless of the resistance of said rank resistor.

3. A recording apparatus according to claim 1, further comprising temperature control means for maintaining an environmental temperature constant.

4. A recording apparatus comprising:

a recording head including a semiconductor substrate in which is formed a heat generating resistor for converting electric energy into thermal energy, for providing a liquid with the thermal energy to generate a bubble in the liquid, thereby discharging the liquid for recording on a recording medium; and a control circuit which controls said recording head, at the discharge of the liquid, in such a manner as to apply a first pulse voltage to said heat generating resistor to heat the liquid in the vicinity of said heat generating resistor and, after a lapse of a predetermined time, to apply a second pulse voltage to said heat generating resistor to generate the bubble, thereby discharging the liquid, and which sets a pulse width of the first pulse voltage, a pulse width of the second pulse voltage and the predetermined time by referring to a rank table showing a relationship between a resistance of a rank resistor corresponding to a resistance of said heat generating resistor and the pulse width of the first pulse voltage, the predetermined time and the pulse width of the second pulse voltage;

wherein said control circuit sets the predetermined time, by referring to the rank table in which the predetermined time is set in such a manner as to become longer as the resistance of said rank resistor becomes smaller.

5. A recording apparatus according to claim 4, further comprising temperature control means for maintaining an environmental temperature constant.

6. A recording apparatus according to any of claims 1 to 5, wherein said recording head includes plural discharge ports for discharging the liquid, and a member for constituting plural liquid flow paths communicating with said discharge ports, respectively.

7. A recording apparatus according to any of claims 1 to 5, further comprising drive signal supply means for supplying said recording head with a drive signal for driving said recording head, and recording medium conveying means for conveying the recording medium to be printed on by said recording head.

8. A liquid discharge method for a recording apparatus including a recording head provided with a semiconductor substrate in which is formed a heat generating resistor for converting electric energy into thermal energy, for providing a liquid with the thermal energy to generate a bubble in the liquid, thereby discharging the liquid for recording on a recording medium, and a control circuit which controls the recording head, at the discharge of the liquid, in such a manner as to apply a first pulse voltage to the heat generating resistor to heat the liquid in the vicinity of the heat generating resistor and, after a lapse of a predetermined time, to apply a second pulse voltage to the heat generating resistor to generate the bubble, thereby discharging the liquid, the liquid discharge method executing a discharge of the liquid by setting a pulse width of the first pulse voltage, a pulse width of the second pulse voltage and the predetermined time by referring to a rank table showing a relationship between a resistance of a rank resistor corresponding to a resistance of the heat generating resistor and the pulse width of the first pulse voltage, the predetermined time and the pulse width of the second pulse voltage, the method comprising steps of:

setting the pulse width of the first pulse voltage, based on a rank table in which the pulse width of the first pulse voltage is set in such a manner that a maximum reached temperature of a surface of the heat generating resistor at an application of the first pulse voltage becomes higher as the resistance of the rank resistor becomes smaller; and discharging the liquid from the recording head based on the set pulse width of the first pulse voltage.

9. A liquid discharge method according to claim 8, wherein the predetermined time in the rank table is made constant regardless of the resistance of said rank resistor.

10. A liquid discharge method for a recording apparatus including a recording head provided with a semiconductor substrate in which is formed a heat generating resistor for converting electric energy into thermal energy, for providing a liquid with the thermal energy to generate a bubble in the liquid, thereby discharging the liquid for recording on a recording medium, and a control circuit which controls the recording head, at the discharge of the liquid, in such a manner as to apply a first pulse voltage to the heat generating resistor to heat the liquid in the vicinity of the heat generating resistor and, after a lapse of a predetermined time, to apply a second pulse voltage to the heat generating resistor to generate the bubble, thereby discharging the liquid, the liquid discharge method executing a discharge of the liquid by setting a pulse width of the first pulse voltage, a pulse width of the second pulse voltage and the predetermined time by referring to a rank table showing a relationship between a resistance of a rank resistor corresponding to a resistance of the heat generating resistor and the pulse width of the first pulse voltage, the predetermined time and the pulse width of the second pulse voltage, the method comprising steps of:

setting the predetermined time, based on the rank table in which the predetermined time is set in such a manner as to become longer as the resistance of the rank resistor becomes smaller; and discharging the liquid from the recording head based on the predetermined time.

11. A recording apparatus comprising:

a recording head including a semiconductor substrate in which is formed a heat generating resistor for converting electric energy into thermal energy, for providing a liquid with the thermal energy to generate a bubble in the liquid, thereby discharging the liquid for recording on a recording medium; and a control circuit which controls said recording head, at the discharge of the liquid, in such a manner as to apply a first pulse voltage to said heat generating resistor to heat the liquid in the vicinity of said heat generating resistor and, after a lapse of a predetermined time, to apply a second pulse voltage to said heat generating resistor to generate the bubble, thereby discharging the liquid, which refers to a pulse table showing a relationship between a pulse width of the first pulse voltage, the predetermined time and a pulse width of the second pulse voltage, determined in accordance with a resistance value of said heat generating resistor, and which sets the pulse width of the first pulse voltage, the pulse width of the second pulse voltage and the predetermined time, wherein the pulse width of the first pulse voltage is set in the pulse table in such a manner that, in a case where a sum of the pulse width of the first pulse voltage and the pulse width of the second pulse voltage is 3 $\mu$sec or less, a maximum reached temperature of a surface of said heat generating resistor at an application of the first pulse voltage becomes higher as the resistance value becomes smaller.

* * * * *

UNITED STATES PATENT AND TRADEMARK OFFICE

CERTIFICATE OF CORRECTION

PATENT NO. : 6,988,782 B2
APPLICATION NO. : 10/293359
DATED : January 24, 2006
INVENTOR(S) : Yoshiyuki Imanaka It is certified that error appears in the above-identified patent and that said Letters Patent is hereby corrected as shown below:

ON THE COVER PAGE
At Item (57) Abstract, line 13, "sating" should read --sating for--.

COLUMN 2
Line 8, "tank" should read --rank--.
Line 40, "terminals" should read --terminal--.

COLUMN 6
Line 37, "tank" should read --rank--.

COLUMN 7
Line 62, "a" should read --to a--.

COLUMN 8
Line 50, "the" should read --for the--.
Line 53, "tain" should read --Tained--.

COLUMN 10
Line 24, "reach temperature" should read --reached temperature--.
Line 58, "compensating" should read --compensating for--.

COLUMN 12
Line 60, "compensating" should read --compensating for--.

Signed and Sealed this

Fifth Day of September, 2006

JON W. DUDAS
*Director of the United States Patent and Trademark Office*